US007204489B1

(12) United States Patent
Rohrbaugh

(10) Patent No.: US 7,204,489 B1
(45) Date of Patent: Apr. 17, 2007

(54) COLLAPSIBLE CORRUGATED TARGET FOR TANK GUNNERY PRACTICE

(76) Inventor: George Wilson Rohrbaugh, 7612 Woolverton Way, Alexandria, PA (US) 16611

( * ) Notice: Subject to any disclaimer, the term of this patent is extended or adjusted under 35 U.S.C. 154(b) by 0 days.

(21) Appl. No.: 11/233,784

(22) Filed: Sep. 22, 2005

(51) Int. Cl.
*F41J 1/08* (2006.01)

(52) U.S. Cl. ..... 273/407; 273/403

(58) Field of Classification Search ..... 273/348, 273/348.1, 403–410
See application file for complete search history.

(56) References Cited

U.S. PATENT DOCUMENTS 3,682,478 A * 8/1972 Knight ..... 273/408
3,685,830 A * 8/1972 Holm ..... 273/348
4,416,456 A * 11/1983 Knight ..... 273/359
4,503,101 A * 3/1985 Bennett ..... 428/9
5,211,404 A * 5/1993 Grant ..... 273/407
5,403,017 A * 4/1995 Doss et al. ..... 273/372
5,671,924 A * 9/1997 Scott ..... 273/407
5,934,678 A * 8/1999 Theissen et al. ..... 273/386
5,947,477 A * 9/1999 Turnipseed ..... 273/407
6,994,347 B2 * 2/2006 Tessel et al. ..... 273/373

* cited by examiner

*Primary Examiner*—Mark S. Graham

(57) ABSTRACT

This invention is a new-type, full-scale, tank-target silhouette for use in tank gunnery practice with the main gun of a tank. The new target employs lightweight sheet material that is corrugated in the manner of an accordion-door (or pleated) configuration to produce a self-supporting, rigid target silhouette which can be raised and lowered, and which can sustain multiple hits without collapsing. The corrugation configuration, when clamped along the bottom edge of the ridges and grooves, provides the necessary rigidity for the target to stand upright without other vertical structural members which could be hit and destroyed.

1 Claim, 5 Drawing Sheets

COLLAPSIBLE CORRUGATED TARGET
FOR TANK GUNNERY PRACTICE
G. Rohrbaugh

COLLAPSIBLE CORRUGATED TARGET
FOR TANK GUNNERY PRACTICE
G.Rohrbaugh

COLLAPSIBLE CORRUGATED TARGET
FOR TANK GUNNERY PRACTICE
G.Rohrbaugh

COLLAPSIBLE CORRUGATED TARGET
FOR TANK GUNNERY PRACTICE
G.Rohrbaugh

COLLAPSIBLE CORRUGATED TARGET
FOR TANK GUNNERY PRACTICE
G.Rohrbaugh

COLLAPSIBLE CORRUGATED TARGET FOR TANK GUNNERY PRACTICE

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

1. Field of the Invention

This invention is a silhouette target for use in live-fire tank gunnery practice. This invention is a free-standing target silhouette which will not be easily destroyed by the large-caliber projectiles fired through it.

2. Discussion of Prior Art

The basic method for constructing a large target silhouette for use in tank gunnery practice is to use ½", or thicker, 4'×8' sheets of plywood or particle board supported by 2"×4" or 4"×4" framing lumber. The 4'×8' sheets of plywood are cut and assembled downrange near the target lifting mechanism and nailed or screwed to the framing lumber. The vertical supports of 2"×4" or 4"×4" lumber are attached to a lifting mechanism, positioned behind a protective berm, that rotates the target silhouette into the exposed upright position above the berm.

A full-scale frontal tank silhouette is approximately 12' wide and 8' high and weighs nearly 200 lbs. The actual weight depends on the panel thickness and the length of the vertical supports. The vertical supports are needed to add strength to the plywood panels and to raise the target silhouette above the protective earth mound in front of the target lifting mechanism. With a long lever arm (vertical support length) the torque required to rotate the target becomes very large (200 lbs.×6'=1200 ft-lb., for example) and a large and powerful lifting mechanism is required.

Examples of heavy rigid targets requiring substantial lifting mechanisms are shown in U.S. Pat. No. 5,403,017 "Target Lifter with Impact Sensing" by Doss, III, et al. and in U.S. Pat. No. 4,330,129 "Light Duty Target Support Apparatus" by Meredith.

A serious limitation of the present technique is the durability of the target and vertical supports. A few well-placed shots from a 120 mm gun can shatter the vertical supports and destroy the target. Another limitation is the excessive fabrication time, as well as the time for the frequent repairs, which require several men to handle the heavy materials involved in the process. The range down-time required to build and repair targets used in gunnery practice reduces the amount and effectiveness of range time available for training.

3. References of Prior Art

The following list of patents is given as reference for known prior practices.

| | | |
|---|---|---|
| 3,733,073 | May 1973 | Gutler |
| 4,119,317 | October 1978 | Ohlund, et al. |
| 4,232,867 | November 1980 | Tate, Sr. |
| 4,260,160 | April 1981 | Ejnell, et al. |
| 4,330,129 | May 1982 | Meredith |
| 4,405,132 | September 1983 | Thalmann |
| 4,799,688 | January 1989 | Kellman, et al. |
| 4,946,171 | August 1990 | Merle, et al. |
| 5,065,032 | November 1991 | Prosser |
| 5,403,017 | April 1995 | Doss, III, et al. |

SUMMARY OF THE INVENTION

The main object of this invention is to provide a large, lightweight, self-supporting, full-scale tank-target silhouette using sheet material which is corrugated along the horizontal direction to form vertical ridges and grooves, similar to the construction of an accordion-folded door.

Another object of the invention is to provide a structurally-rigid target silhouette which is formed by clamping the corrugated target material along the bottom edge of the vertical ridges and grooves with a target holder mechanism that maintains the cross-sectional corrugated shape and that can be rotated backward and forward to lower and raise the target into the firing position.

Another object of the invention is to provide a tank target without structural upright supports which is capable of withstanding multiple hits from the 120 mm large-caliber main gun of the tank during gunnery practice.

Another object of the invention is to provide a lightweight folded target which can be transported easily to the target area, unfolded, and installed in the target holder in a few minutes by one man.

Another object of the invention is to provide a full-scale tank-target silhouette which is lightweight enough to reduce the size and power of the drive mechanism required to raise and lower the target.

DETAILED DESCRIPTION OF THE INVENTION

Figure 1:
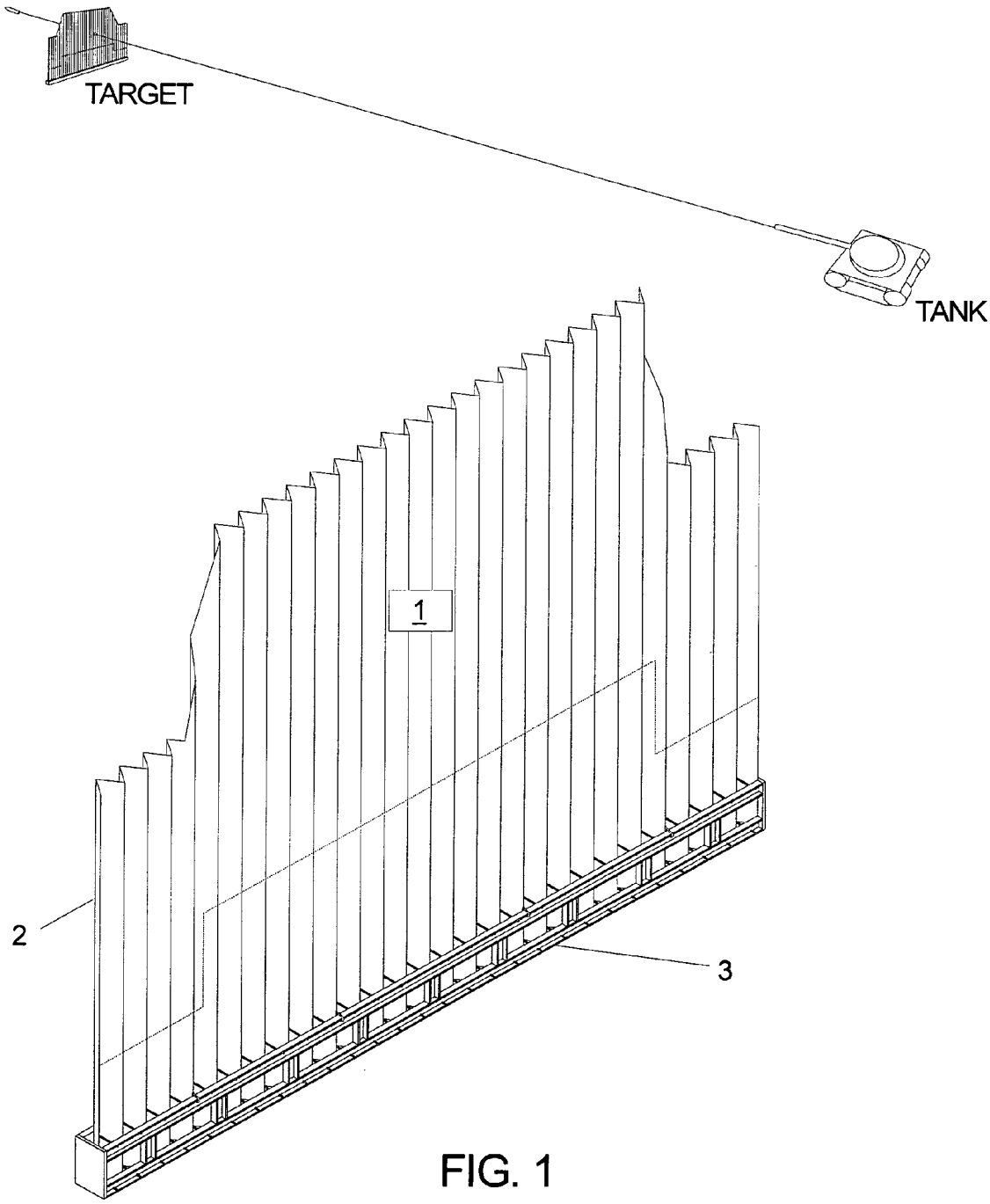
FIG. 1 is an isometric drawing of the frontal view of the tank-target silhouette comprised of corrugated target material (with vertically-aligned ridges and grooves) which is clamped into, and held upright by, a bottom clamping and support beam.

The proposed invention is based on the principle that thin-gauge, lightweight materials such as corrugated cardboard or extruded, ribbed-plastic sheet material gain structural strength when folded in a corrugated or accordion shape and are then clamped along one edge defined by the ridges and grooves of the corrugations. FIG. 1 shows the corrugated tank-target assembly 1 that is described in detail below and includes the corrugated target material 2 and the clamping and support beam assembly 3 that entraps and supports the bottom edge of the target corrugations.

Figure 2:
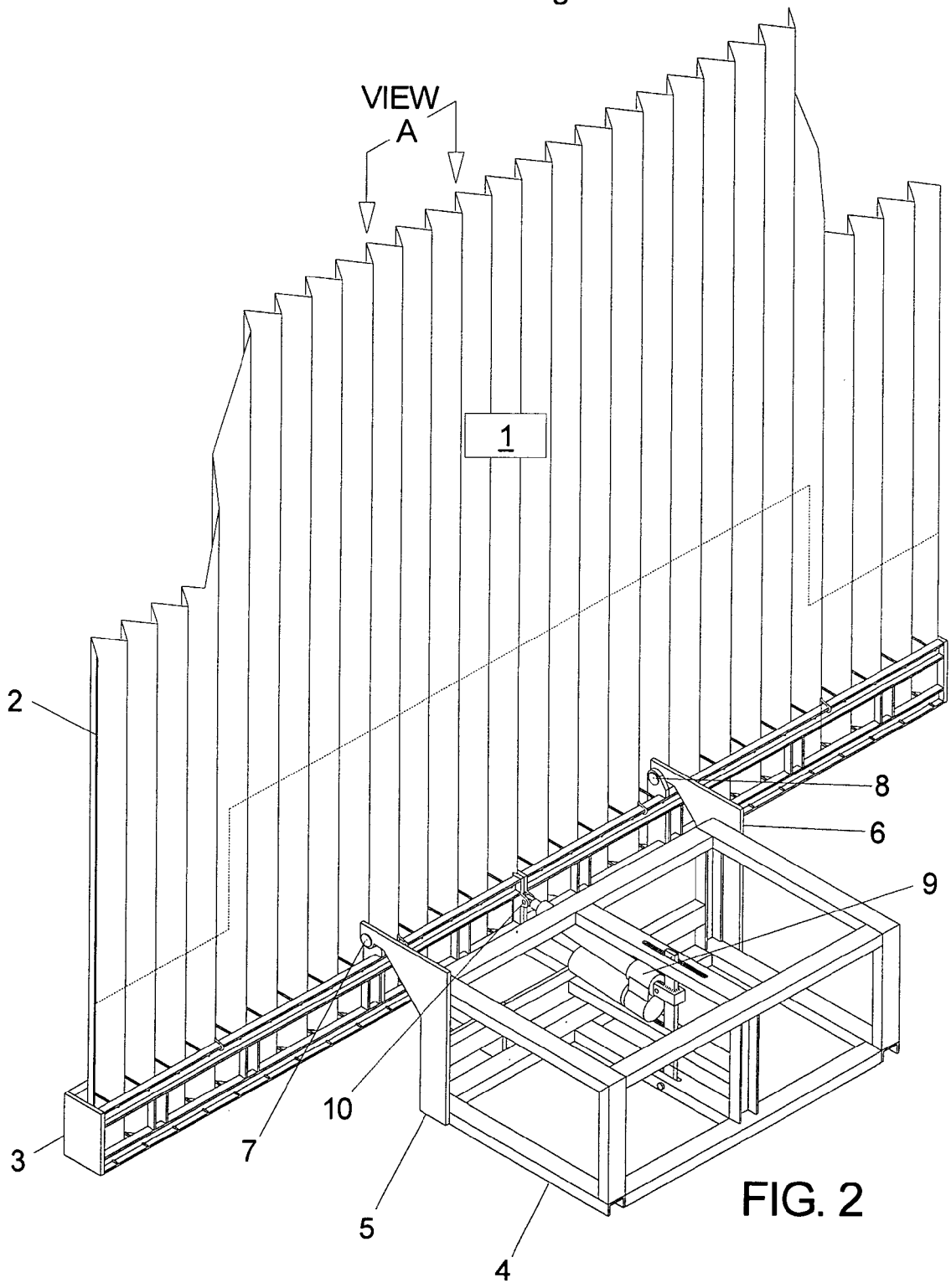
FIG. 2 is an isometric drawing showing the frontal view of the preferred embodiment of the tank-target silhouette and the bottom clamping and support beam attached to a typical lifting mechanism comprised of a mounting support frame, support arms with bearings, and a linear-actuator drive mechanism.

The preferred embodiment of the invention is shown in FIG. 2 through FIG. 6. In FIG. 2 the large full-scale corrugated tank-target assembly 1 is formed when thin-gauge material 2 (such as extruded polypropylene sheet material sold under trade names as "Coroplast," Stratocore," and "Plasticor") is folded along the interior flutes of the extrusions in the vertical direction and then is firmly clamped along the bottom edge in the clamping and support beam assembly 3. The width of the clamping and support beam assembly 3 for a normal-sized frontal tank-target is 12'. The height of the corrugated target silhouette 2 is nominally 8', but could extend to 10' or more, depending on how much of the target is exposed above a protective earthen berm.

Also shown in FIG. 2 is the support frame and lifting mechanism 4 of structural steel or aluminum channel pieces welded to form a rigid framework that supports the rotating, clamped, corrugated tank-target assembly 1. Welded to the framework 4 are two pivot support arms 5 and 6 that attach to the clamping and support beam assembly 3 through two pivot-point bearing plates 7 and 8 around which the entire corrugated tank-target assembly 1 rotates. The 90° rotation of the corrugated tank-target assembly 1 is powered by a linear actuator 9 that pushes and pulls against a 6"-offset lever-arm plate 10 that forces the entire corrugated tank-target assembly 1 to rotate around the pivot points of plates 7 and 8.

Figure 3:
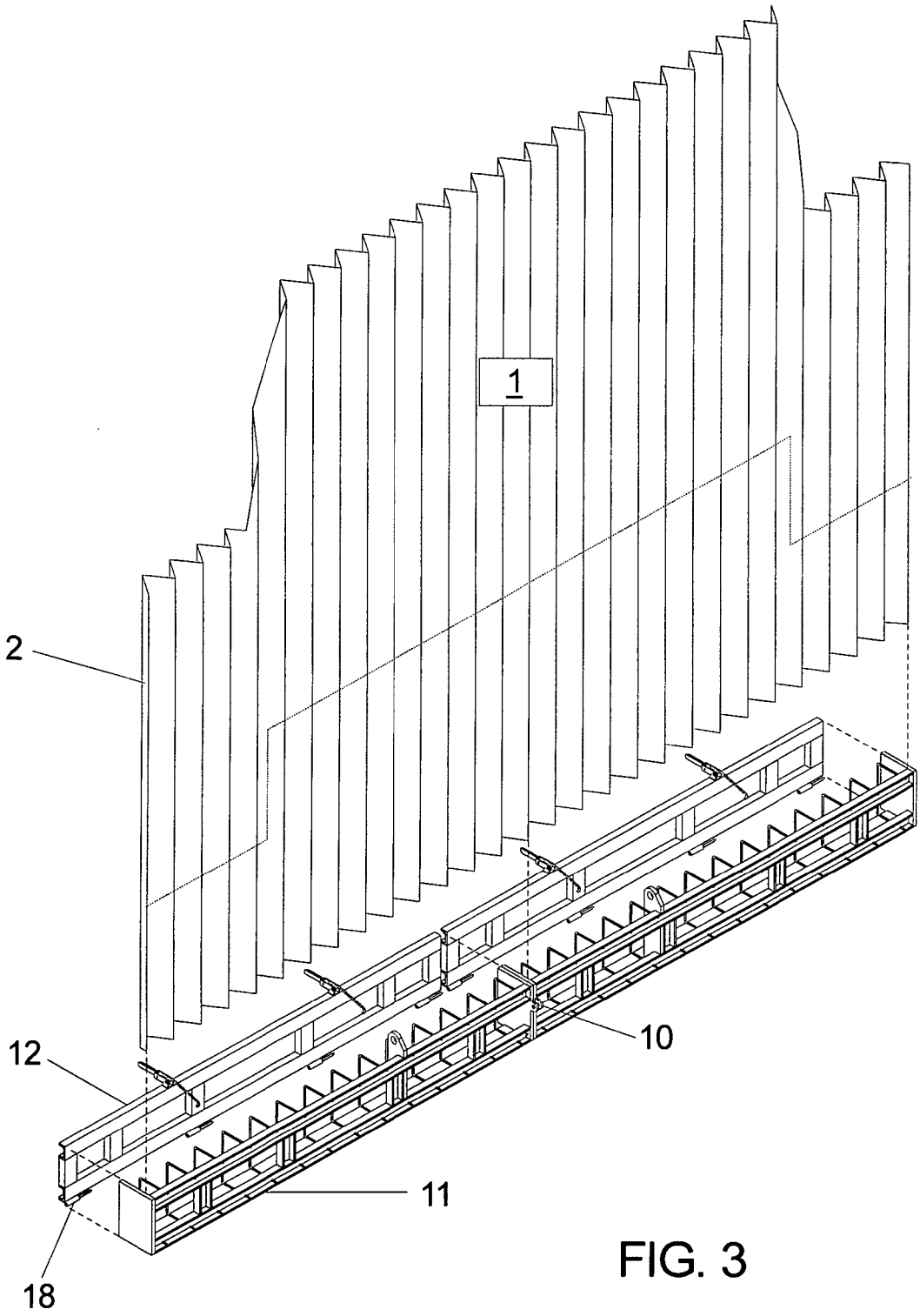
FIG. 3 is an exploded view of the tank-target silhouette assembly of FIG. 1, showing the corrugated target silhouette and the bottom clamping and support beam.
Figure 4:
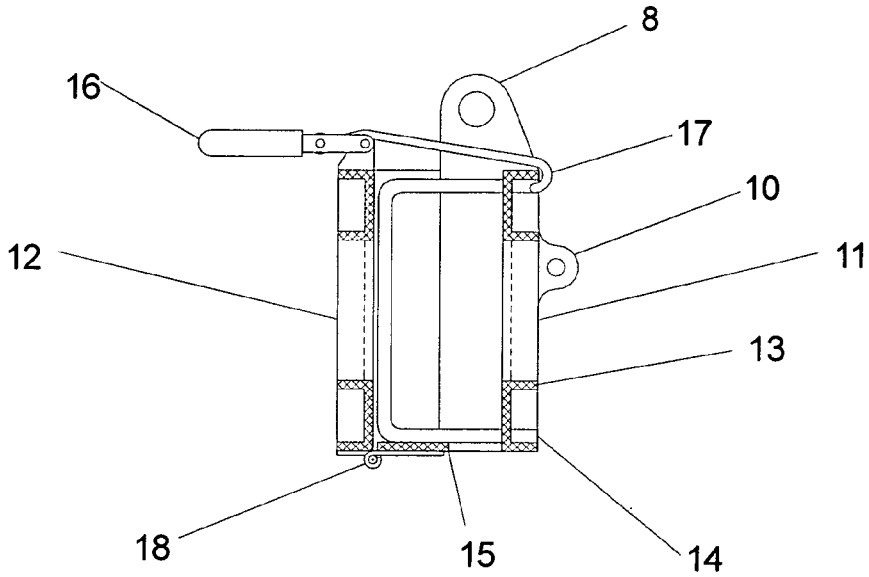
FIG. 4 is a typical cross-sectional view of the preferred embodiment of FIG. 2, detached from the lifter mechanism and without the corrugated target material, that shows the clamping and support beam in the closed, or clamped, position.
Figure 5:
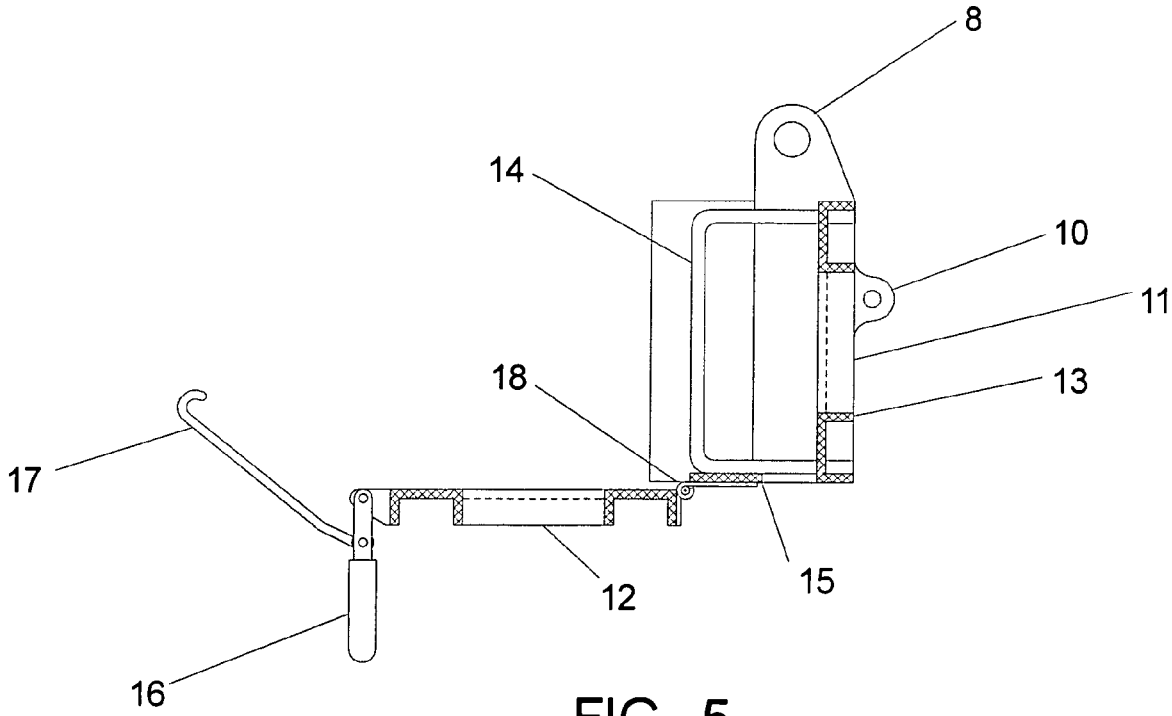
FIG. 5 is a typical cross-sectional view of the preferred embodiment of FIG. 2, detached from the lifter mechanism and without the corrugated target material, that shows the clamping and support beam in the open, or unclamped, position.

FIG. 3, FIG. 4, and FIG. 5 show additional details for the clamping and support beam assembly 3. As shown in FIG. 3, which is an exploded view of the corrugated tank-target assembly 1 of FIG. 1, the clamping and support beam assembly 3 consists of two detachable parts: the support beam assemble 11 and the hinged clamping beam assembly 12. Each of the beam assemblies 11 and 12 is shown in the preferred split configuration where the support beam assembly 11 and the hinged clamping beam assembly 12 are each half the final overall width of the clamping and support beam assembly 3. During installation the halves of the support beam assembly 11 are bolted together at the center using the welded aluminum 6"-offset lever-arm end plates 10 which also provide the pivot point for the linear-actuator drive mechanism 9. The two halves of the hinged clamping beam assembly 12 are assembled separately by connecting half the hinged clamping beam assembly 12 at a time to the support beam assembly 11 using hinges 18.

FIG. 4 is a typical cross-sectional view of the preferred embodiment of FIG. 2, detached from the support frame and lifter mechanism 4 and without the corrugated target material 2 installed, that shows the clamping and support beam assembly 3 in the closed, or clamped, position. FIG. 5 shows the same clamping and support beam assembly 3 of the preferred embodiment of FIG. 2 in the open, or unclamped, position. As shown in FIG. 4 and in FIG. 5 the clamping and support beam assembly 3 consists of a structural support beam assembly 11 and a clamping beam assembly 12. The structural support beam 11 is a welded assembly consisting of aluminum channel pieces 13, bent aluminum clamping rods 14, and a ¼"-thick aluminum structural plate 15 that runs the length of the support beam assembly 11. The aluminum channel is typically 2½"×1"×¼" of appropriate length. The bent aluminum clamping rods 14 are typically ⅜" diameter and of sufficient number to clamp every other vertical fold, or groove, in the corrugated target material 2.

Again referring to FIG. 4 and to FIG. 5, the hinged clamping beam assembly 12 is a welded assembly, similar to that of the support beam assembly 11 described above, employing the same type aluminum channel pieces 13. The clamping beam assembly 12 is attached to the support beam assembly 11 by a series of slide-off hinges 18 that are attached to the respective assemblies. The 2-piece slide-off hinges have the socket-half of the hinges 18 welded to the structural plate 15 on the support beam assembly 11. The pin-half of the hinges 18 are welded to the aluminum channel of the hinged clamping beam assembly 12. Each half of the clamping beam assembly 12 is fitted with two toggle clamps 16 that have hook-type arms 17 that pass through small cut-outs in the corrugated target material 2 and engage the top channel 13 of the support beam assembly 11. When closed, the toggle clamps provide the clamping force to securely hold the corrugated target material 2 in the clamping and support beam assembly 3.

Figure 6:
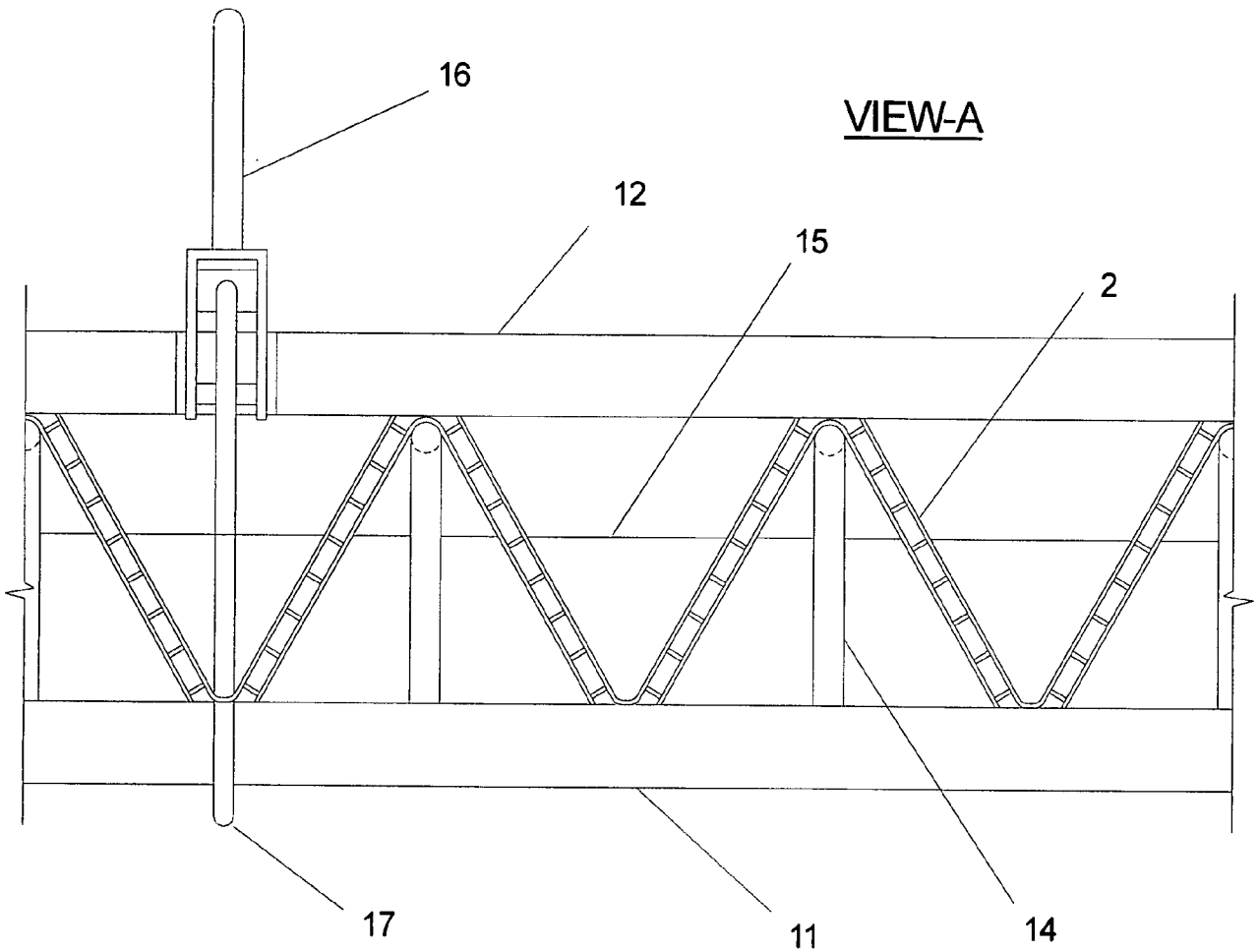
FIG. 6 is a top view of the preferred embodiment of FIG. 2 that shows a small section of the accordion-folded silhouette with the clamping and support beam in the closed, or clamped, position and a typical toggle clamp.

Refer now to FIG. 6 which shows a top view, View-A, of a small section of the corrugated target material 2 and the clamping and support beam assembly 3 in the clamped position for the preferred embodiment of FIG. 2. FIG. 6 shows the corrugated target material 2 firmly clamped by the bent clamping rods 14 and the toggle clamp 16 with hook 17 between the support beam assembly 11 and the hinged clamping beam assembly 12.

In practice, to replace a target silhouette, a new folded target silhouette 2, which collapses to a bundle approximately 12" W×4" D×96" H in size when folded and which weighs less than 50 lbs., is carried downrange to a target lifting mechanism 4 with clamping and support beam assembly 3 already installed. As described above, the toggle clamps 16 with hook 17 are loosened, the hinged clamping beam assembly 12 is opened, and the old target silhouette 2 is removed. The new collapsed corrugated target silhouette 2 is unfolded and installed into the support beam assembly 11 and then the clamping beam assembly 12 is hinged closed and clamped by the toggle clamps 16.

It is understood that many other methods and materials can be used to form the clamping and support assembly 3 described above. For example, the bottom support assembly could be constructed using an epoxy/fiberglas molding technique with molds designed to match the saw-tooth pattern of the accordion folds of the target silhouette. The hollow fiberglas pieces that would be formed by this technique would then be filled with structural foam to form lightweight rigid clamping members which would be hinged and clamped in a manner similar to the aluminum-channel method described above in the preferred embodiment. It is also envisioned that the bottom of the corrugated target could be held in place by inserting two small tubes, or pipes, through holes in the corrugations across the width of the target silhouette and clamping the tubes to form a rigid dual-rail structure on which the silhouette is held in place.

I claim:

1. A full-scale tank target silhouette which is formed from a sheet material that is folded to form corrugations in the horizontal direction with the ridges and grooves of the resulting corrugation running in a vertical direction to give structural strength to the said sheet material which is then securely clamped along the bottom edge using a hinged holding clamp with evenly spaced members that extend into the corrugated material at each groove to provide the clamping force for the free-standing, full-scale, tank-target silhouette image for use in tank gunnery target practice with live ammunition.

* * * * *